US010328688B2

(12) United States Patent
Chopra et al.

(10) Patent No.: US 10,328,688 B2
(45) Date of Patent: Jun. 25, 2019

(54) TUNABLE SURFACTANTS IN DAMPENING FLUIDS FOR DIGITAL OFFSET INK PRINTING APPLICATIONS

(71) Applicants: Xerox Corporation, Norwalk, CT (US); Palo Alto Research Center Incorporated, Palo Alto, CA (US)

(72) Inventors: Naveen Chopra, Oakville (CA); Peter Gordon Odell, Mississauga (CA); Steven E. Ready, Los Altos, CA (US); Eric Peeters, Fremont, CA (US); Timothy D. Stowe, Alameda, CA (US); Ashish Pattekar, Cupertino, CA (US); David K. Biegelsen, Portola Valley, CA (US)

(73) Assignees: Xerox Corporation, Norwalk, CT (US); Palo Alto Research Corporation, Palo Alto, CA (US)

( * ) Notice: Subject to any disclaimer, the term of this patent is extended or adjusted under 35 U.S.C. 154(b) by 101 days.

(21) Appl. No.: 15/496,709

(22) Filed: Apr. 25, 2017

(65) Prior Publication Data

US 2017/0225452 A1 Aug. 10, 2017

Related U.S. Application Data

(62) Division of application No. 14/522,015, filed on Oct. 23, 2014, now Pat. No. 9,713,828, which is a division (Continued)

(51) Int. Cl.
*B41F 35/06* (2006.01)
*B08B 3/08* (2006.01)

(Continued)

(52) U.S. Cl.
CPC ..... *B41F 35/06* (2013.01); *B08B 3/08* (2013.01); *B08B 3/10* (2013.01); *B41F 7/04* (2013.01);

(Continued)

(58) Field of Classification Search
None
See application file for complete search history.

(56) References Cited

U.S. PATENT DOCUMENTS 1,959,461 A 5/1934 Delfs
3,634,015 A 1/1972 Lauderback et al.

(Continued)

FOREIGN PATENT DOCUMENTS

JP 07-179773 7/1995

OTHER PUBLICATIONS

Hellberg et al., "Cleavable Surfactants," Journal of Surfactants and Detergents, vol. 3, No. 1, pp. 81-91 (Jan. 2000).

(Continued)

*Primary Examiner* — Katie L. Hammer
(74) *Attorney, Agent, or Firm* — Caesar Rivise, PC

(57) ABSTRACT

A dampening fluid useful in offset ink printing applications contains water and a surfactant whose structure can be altered. The alteration in structure aids in reducing accumulation of the surfactant on the surface of an imaging member. The surfactant can be decomposed, switched between cis-trans states, or polymerizable with ink that is subsequently placed on the surface.

14 Claims, 2 Drawing Sheets

Related U.S. Application Data of application No. 13/268,213, filed on Oct. 7, 2011, now abandoned.

(51) Int. Cl.

| | |
|---|---|
| ***B08B 3/10*** | (2006.01) |
| ***B41F 35/02*** | (2006.01) |
| ***B41F 7/04*** | (2006.01) |
| ***B41F 7/24*** | (2006.01) |
| ***B41F 7/30*** | (2006.01) |
| ***B41N 3/08*** | (2006.01) |

(52) U.S. Cl.

CPC ..... *B41F 7/24* (2013.01); *B41F 7/30* (2013.01); *B41F 35/02* (2013.01); *B41N 3/08* (2013.01); *B41P 2200/21* (2013.01); *B41P 2227/20* (2013.01); *B41P 2235/10* (2013.01); *B41P 2235/50* (2013.01)

(56) References Cited

U.S. PATENT DOCUMENTS

| | | | | |
|---|---|---|---|---|
| 3,763,141 | A | 10/1973 | Weaver et al. | |
| 3,769,043 | A | 10/1973 | Morishima et al. | |
| 3,867,147 | A | 2/1975 | Teuscher | |
| 3,877,372 | A | 4/1975 | Leeds | |
| 5,766,818 | A | 6/1998 | Smith et al. | |
| 5,863,698 | A | 1/1999 | Patel et al. | |
| 5,928,832 | A | 7/1999 | Smith et al. | |
| 6,132,924 | A | 10/2000 | Patel et al. | |
| 7,020,355 | B2 * | 3/2006 | Lahann | B01D 15/3861 365/151 |
| 7,622,596 | B1 | 11/2009 | McElhanon et al. | |
| 8,507,182 | B2 | 8/2013 | Figov et al. | |
| 2002/0083865 | A1 | 7/2002 | Krishnan et al. | |
| 2003/0072200 | A1 * | 4/2003 | Vincent | C09K 9/02 365/200 |
| 2007/0072110 | A1 * | 3/2007 | Iftime | G03C 1/002 430/270.1 |
| 2008/0041257 | A1 * | 2/2008 | Teng | B41C 1/1008 101/453 |
| 2008/0160450 | A1 * | 7/2008 | Schlorholz | B41N 3/03 430/302 |
| 2008/0213574 | A1 | 9/2008 | McKee et al. | |
| 2008/0311491 | A1 * | 12/2008 | Iftime | G03C 1/733 430/19 |
| 2010/0310989 | A1 | 12/2010 | Figov et al. | |
| 2011/0023740 | A1 | 2/2011 | Ray et al. | |
| 2011/0026050 | A1 * | 2/2011 | Ray | G03G 9/06 358/1.9 |
| 2011/0281104 | A1 * | 11/2011 | Iftime | B41M 7/0036 428/327 |
| 2012/0042798 | A1 | 2/2012 | Bradley et al. | |
| 2012/0175529 | A1 * | 7/2012 | Naciri | B82B 1/002 250/492.1 |
| 2015/0099229 | A1 | 4/2015 | Simpson et al. | |
| 2016/0214370 | A1 | 7/2016 | Hendrikx et al. | |

OTHER PUBLICATIONS

HCAPLUS Accession No. 195-869480, Title: Azo compound surfactants for electrochemical deposition of functional materials in thin films, by Saji,Tetsuo, entered in STN on Oct. 21, 1995.

* cited by examiner

TUNABLE SURFACTANTS IN DAMPENING FLUIDS FOR DIGITAL OFFSET INK PRINTING APPLICATIONS

CROSS-REFERENCE TO RELATED APPLICATIONS

This application is a divisional of U.S. patent application Ser. No. 14/522,015, filed Oct. 23, 2014, which is a divisional of U.S. patent application Ser. No. 13/268,213, filed Oct. 7, 2011, now abandoned, and all of which are titled "Tunable Surfactants in Dampening Fluids for Digital Offset Ink Printing Applications". The present disclosure is related to U.S. patent application Ser. No. 13/095,714, filed Apr. 27, 2011, titled "Variable Data Lithography System", now abandoned.

BACKGROUND

The present disclosure is related to marking and printing methods and systems, and more specifically to methods and systems providing control of conditions local to the point of writing data to a reimageable surface in variable data lithographic systems.

Offset lithography is a common method of printing today. (For the purposes hereof, the terms "printing" and "marking" are interchangeable.) In a typical lithographic process a printing plate, which may be a flat plate, the surface of a cylinder, or belt, etc., is formed to have "image regions" formed of a hydrophobic/oleophilic material, and "non-image regions" formed of a hydrophilic/oleophobic material. The image regions correspond to the areas on the final print (i.e., the target substrate) that are occupied by a printing or marking material such as ink, whereas the non-image regions correspond to the areas on the final print that are not occupied by said marking material. The hydrophilic regions accept and are readily wetted by a water-based fluid, commonly referred to as a dampening fluid or fountain fluid (typically consisting of water and a small amount of alcohol as well as other additives and/or surfactants to reduce surface tension). The hydrophobic regions repel dampening fluid and accept ink, whereas the dampening fluid formed over the hydrophilic regions forms a fluid "release layer" for rejecting ink. The hydrophilic regions of the printing plate thus correspond to unprinted areas, or "non-image areas", of the final print.

The ink may be transferred directly to a target substrate, such as paper, or may be applied to an intermediate surface, such as an offset (or blanket) cylinder in an offset printing system. The offset cylinder is covered with a conformable coating or sleeve with a surface that can conform to the texture of the target substrate, which may have surface peak-to-valley depth somewhat greater than the surface peak-to-valley depth of the imaging plate. Also, the surface roughness of the offset blanket cylinder helps to deliver a more uniform layer of printing material to the target substrate free of defects such as mottle. Sufficient pressure is used to transfer the image from the offset cylinder to the target substrate. Pinching the target substrate between the offset cylinder and an impression cylinder provides this pressure.

Typical lithographic and offset printing techniques utilize plates which are permanently patterned, and are therefore useful only when printing a large number of copies of the same image (i.e. long print runs), such as magazines, newspapers, and the like. However, they do not permit creating and printing a new pattern from one page to the next without removing and replacing the print cylinder and/or the imaging plate (i.e., the technique cannot accommodate true high speed variable data printing wherein the image changes from impression to impression, for example, as in the case of digital printing systems). Furthermore, the cost of the permanently patterned imaging plates or cylinders is amortized over the number of copies. The cost per printed copy is therefore higher for shorter print runs of the same image than for longer print runs of the same image, as opposed to prints from digital printing systems.

Accordingly, a lithographic technique, referred to as variable data lithography, has been developed which uses a non-patterned reimageable surface that is initially uniformly coated with a dampening fluid layer. Regions of the dampening fluid are removed by exposure to a focused radiation source (e.g., a laser light source) to form pockets. A temporary pattern in the dampening fluid is thereby formed over the non-patterned reimageable surface. Ink applied thereover is retained in the pockets formed by the removal of the dampening fluid. The inked surface is then brought into contact with a substrate, and the ink transfers from the pockets in the dampening fluid layer to the substrate. The dampening fluid may then be removed, a new uniform layer of dampening fluid applied to the reimageable surface, and the process repeated.

The patterning of dampening fluid on the reimageable surface in variable data lithography essentially involves using a laser or other energy source to impart thermal energy to selectively boil off or ablate the dampening fluid in selected locations. However, the surfactants used to provide improved wetting of the dampening fluid over the reimageable surface may not evaporate or boil off with the water due to naturally high boiling points and low vapor pressures of the surfactants.

Therefore surfactants may accumulate on the surface of the imaging member over time, compromising the integrity of the imaging member for making images of suitable quality. It would be desirable, among other things, to reduce the accumulation of surfactants on the surface of the imaging member.

BRIEF DESCRIPTION

The present disclosure relates to dampening fluids containing a surfactant that produces lower accumulations on the surface of a reimageable cylinder. The dampening fluid includes an aqueous solvent such as water, a surfactant whose structure or composition can be altered or changed, and optionally other additives.

Three different general types of surfactants are contemplated here. The first type of surfactant can be decomposed, for example by cleavage after the application of light or heat. The byproducts of cleavage of the surfactant may be volatile gases or compounds that leave the surface of the imaging member. Alternatively, the byproducts may be more amenable to cleanup in subsequent processing steps.

The second type of surfactant is a cis-trans isomer having a dipole moment. Through the use of light and heat, the surfactant can be switched between the cis and trans isomers. In one state, the surfactant is non-polar, while in the other state the surfactant is polar. This would allow the surfactant to be more ink-accepting for subsequent image-wise impressions (rather than continuing to repel the ink).

The third type of surfactant is a polymerizable surfactant that could become incorporated into the ink which may be laid down in subsequent image-wise impressions.

Disclosed herein in certain embodiments is a dampening fluid for offset printing, comprising water and a surfactant having an alterable structure. The surfactant can be decomposed, switched between cis-trans isomers with different polarities, or polymerizable with ink.

The structure of the surfactant may be alterable through decomposition upon exposure to light or heat. In some embodiments, the surfactant is an alkyl aryl ketone sulfonate having the structure of Formula (I):

Formula (I)

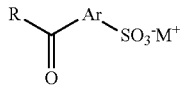

wherein R is alkyl having from 4 to 24 carbon atoms; Ar is aryl having from 6 to 40 carbon atoms; and M is an alkali or alkali earth metal.

In other embodiments, the surfactant is a 4-alkylphenylazosulfonate having the structure of Formula (II):

Formula (II)

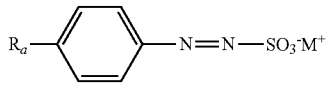

wherein $R_a$ is alkyl having from 4 to 24 carbon atoms; and M is an alkali or alkali earth metal.

Alternatively, the surfactant contains an azide group, a carboxylate group, or a peroxide group which can be decomposed to release a gas or smaller molecular fragments.

In different embodiments, the surfactant is a cis-trans isomer having a dipole moment. In some specific embodiments, the cis-trans isomer is an azobenzene compound having the structure of Formula (III):

Formula (III)

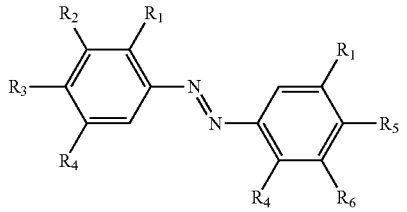

wherein $R_1$, $R_2$, $R_3$, $R_4$, $R_5$, and $R_6$ are independently selected from hydrogen, hydroxyl, carboxylic acid, amino, thiol, cyano, nitro, halogen, vinyl, alkoxy, trialkylammoniumalkoxy, sulfonic acid, phosphonate ester, aldehyde, amide, urea, carbamate, carbonate, alkyl, polyoxyalkylene, and ester; and wherein $R_1$ is different from $R_4$.

In more particular embodiments, the cis-trans isomer is an azobenzene compound having the structure of Formula (III-a):

Formula (III-a)

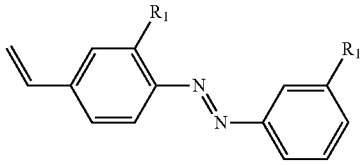

wherein $R_1$ is selected from hydroxyl, amino, cyano, nitro, halogen, vinyl, alkoxy, sulfonic acid, aldehyde, and ester.

In other embodiments, the cis-trans isomer is an azobenzene compound having the structure of Formula (III-b):

Formula (III-b)

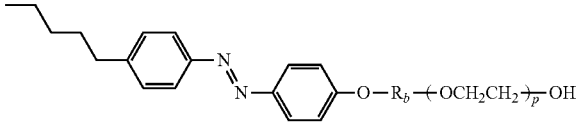

wherein $R_b$ is alkyl having 2 to 6 carbon atoms; and p is an integer from 1 to 10.

In still other embodiments, the cis-trans isomer is an azobenzene compound having the structure of Formula (III-c):

Formula (III-c)

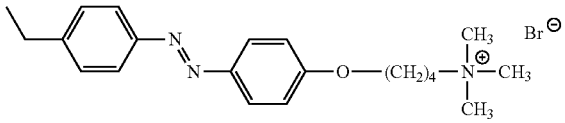

In some embodiments, the surfactant is a polymerizable surfactant. Generally, the surfactant contains a polymerizable group. In particular embodiments, the polymerizable surfactant has the structure of Formula (IV):

T-G Formula (IV)

wherein T is a nonpolar group; G is a polar group; and a polymerizable group is present in either T or G.

In some embodiments, the polymerizable surfactant has the structure of Formula (IV-a):

Formula (IV-a)

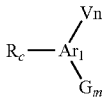

wherein $R_c$ is alkyl containing from 4 to 24 carbon atoms; $Ar_1$ is aryl having from 6 to 40 carbon atoms; Vn is a hydrocarbon chain having a single carbon-carbon double bond; m is an integer indicating the number of polar groups G on $Ar_1$, and is from 1 to 4; and each G is independently a polar group.

G may contain a polyoxyethylene chain.

In some more specific embodiments, the polymerizable surfactant has the structure of Formula (IV-b):

Formula (IV-b)

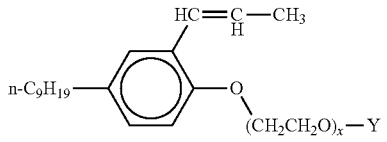

wherein x has an average value of from 1 to about 50; and Y is hydrogen or $—SO_3^-M^+$, where M is a cation having a +1 charge.

Alternatively, the polymerizable surfactant may have the structure of Formula (IV-c):

Formula (IV-c)

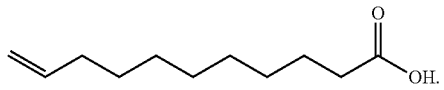

In still other embodiments, the polymerizable surfactant has the structure of Formula (IV-d):

Formula (IV-d)

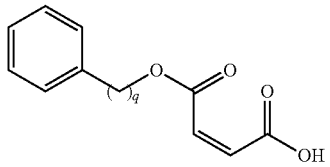

wherein q is an integer from 1 to 7.

The dampening fluid may further comprise a low molecular weight alcohol, such as ethanol or isopropanol.

Also disclosed are methods for cleaning an imaging member during offset printing. A latent image is created on the imaging member in a layer of the dampening fluid. The dampening fluid that comprises water and a surfactant having an alterable structure. Ink is applied to the imaging member to develop the latent image, and is subsequently transferred to a target substrate. As part of the cleaning process, the imaging member is exposed to light or heat to alter the structure of the surfactant. The surfactant is then removed from the imaging member.

These and other non-limiting aspects and/or objects of the disclosure are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
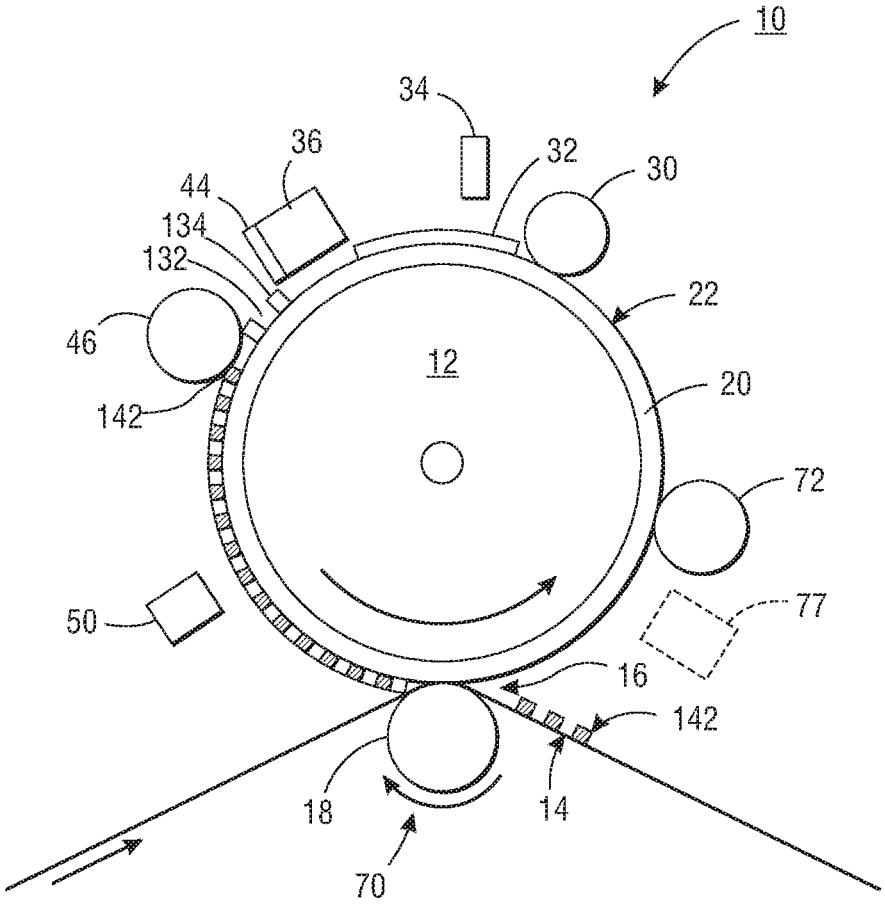
FIG. 1 illustrates a variable lithographic printing apparatus in which the dampening fluids of the present disclosure may be used.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

FIG. 1 illustrates a system for variable lithography in which the dampening fluids of the present disclosure may be used. The system 10 comprises an imaging member 12. The imaging member comprises a substrate 22 and a reimageable surface layer 20. The surface layer is the outermost layer of the imaging member, i.e. the layer of the imaging member furthest from the substrate. As shown here, the substrate 22 is in the shape of a cylinder; however, the substrate may also be in a belt form, etc. The surface layer 20 is typically a silicone (e.g. a methylsilicone or fluorosilicone), which may have carbon black added to increase energy absorption of the surface layer.

In the depicted embodiment the imaging member 12 rotates counterclockwise and starts with a clean surface. Disposed at a first location is a dampening fluid subsystem 30, which uniformly wets the surface with dampening fluid 32 to form a layer having a uniform and controlled thickness. Ideally the dampening fluid layer is between about 0.15 micrometers and about 1.0 micrometers in thickness, is uniform, and is without pinholes. As explained further below, the composition of the dampening fluid aids in leveling and layer thickness uniformity. A sensor 34, such as an in-situ non-contact laser gloss sensor or laser contrast sensor, is used to confirm the uniformity of the layer. Such a sensor can be used to automate the dampening fluid subsystem 30.

At optical patterning subsystem 36, the dampening fluid layer is exposed to an energy source (e.g. a laser) that selectively applies energy to portions of the layer to imagewise evaporate the dampening fluid and create a latent "negative" of the ink image that is desired to be printed on the receiving substrate. Image areas are created where ink is desired, and non-image areas are created where the dampening fluid remains. An optional air knife 44 is also shown here to control airflow over the surface layer 20 for the purpose of maintaining clean dry air supply, a controlled air temperature, and reducing dust contamination prior to inking. Next, an ink is applied to the imaging member using inker subsystem 46. Inker subsystem 46 may consist of a "keyless" system using an anilox roller to meter an offset ink onto one or more forming rollers. Ink is applied to the image areas to form an ink image.

A rheology control subsystem 50 partially cures or tacks the ink image. This curing source may be, for example, an ultraviolet light emitting diode (UV-LED), which can be focused as desired using optics. Another way of increasing the cohesion and viscosity employs cooling of the ink. This could be done, for example, by blowing cool air over the reimageable surface from a jet after the ink has been applied but before the ink is transferred to the final substrate. Alternatively, a heating element could be used near the inker subsystem 46 to maintain a first temperature and a cooling element could be used to maintain a cooler second temperature near the nip 16.

The ink image is then transferred to the target or receiving substrate 14 at transfer subsystem 70. This is accomplished by passing a recording medium or receiving substrate 14, such as paper, through the nip 16 between the impression roller 18 and the imaging member 12.

Finally, the imaging member should be cleaned of any residual ink or dampening fluid. Most of this residue can be easily removed quickly using an air knife 77 with sufficient air flow. Removal of any remaining ink can be accomplished at cleaning subsystem 72.

Figure 2:
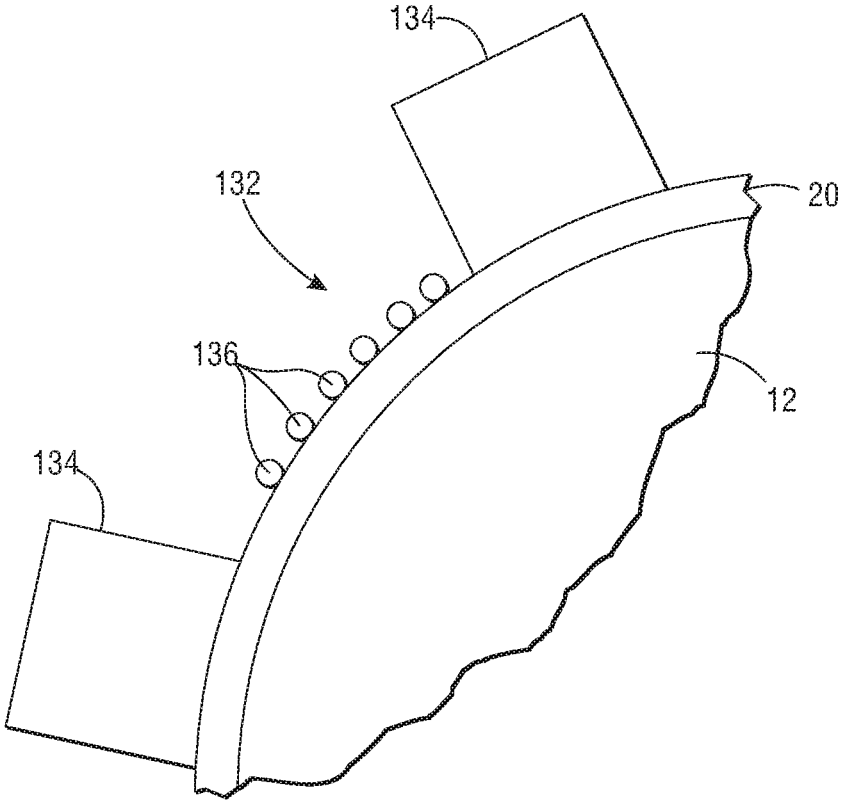
FIG. 2 is a magnified view of the imaging member in the printing apparatus illustrating residual surfactant on the surface.

The role of the dampening fluid is to provide selectivity in the imaging and transfer of ink to the receiving substrate. When an ink donor roll in the ink source of FIG. 1 contacts the dampening fluid layer, the layer splits so that ink 142 is only applied to areas on the imaging member that are dry, i.e. not covered with dampening fluid, and ink in the areas containing dampening fluid remains on the ink donor roll. However, over time, residual surfactants and other additives from the dampening fluid can accumulate on the surface of the imaging member. This is illustrated in FIG. 2, which is a magnified view of the image areas 132 and non-image areas 134 after the latent image has been applied at optical patterning subsystem 36 (FIG. 1) and prior to inker subsystem 46 (FIG. 1). Residual surfactant in image areas 132 is indicated with reference numeral 136.

It is desirable to be able to chemically alter the surfactants so that the surfactant is either easier to remove from the surface or has less effect on subsequent imagewise impressions made on the surface of the imaging member. Surfactants generally include a non-polar tail (which is often an alkyl chain) and a polar head. Three different types of chemical alterations are contemplated. In the first type of surfactant, the surfactant decomposes upon exposure to light or heat. Put another way, the surfactant breaks down into two or more different molecules.

In certain embodiments, the surfactant is an alkyl aryl ketone sulfonate having the structure of Formula (I):

Formula (I)

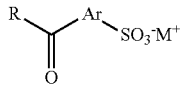

wherein R is alkyl having from 4 to 24 carbon atoms; Ar is aryl having from 6 to 40 carbon atoms; and M is an alkali or alkali earth metal. M may be, for example, hydrogen, sodium, or potassium. The R forms the non-polar tail of the surfactant, with the remainder forming the polar head of the surfactant. Generally, the sulfonate of Formula (I) can be cleaved by exposure to light having a wavelength of 300 nm and above. The cleavage typically results in an aryl sulfonate and a mixture of two branched olefins. As illustrated in Scheme 1 below, the surfactant 4-(3,3-dimethyltridecanoyl) benzenesulfonic acid is cleaved into a mixture of 4-acetylbenzenesulfonic acid, 2-methyldodec-1-ene, and 2-methyldodec-2-ene:

Scheme 1

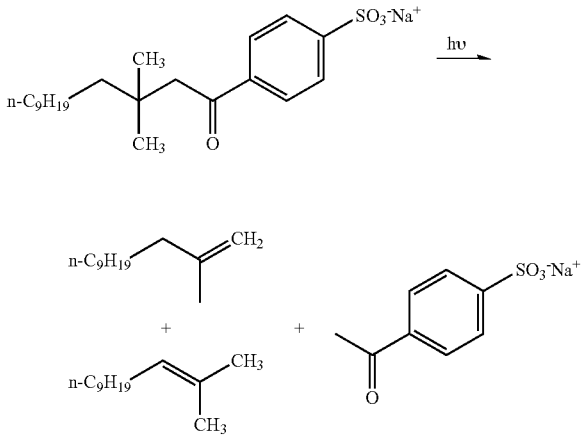

In other embodiments, the surfactant is a 4-alkylphenylazosulfonate having the structure of Formula (II):

Formula (II)

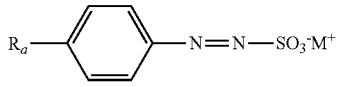

wherein $R_a$ is alkyl having from 4 to 24 carbon atoms; and M is an alkali or alkali earth metal. In particular embodiments, $R_a$ is $—C_{12}H_{25}$, $—C_{10}H_{21}$, $—C_8H_{17}$, or $—C_6H_{13}$. The surfactants of Formula (II) lose their surfactant properties upon ultraviolet (UV) irradiation.

In other specific embodiments, the surfactant contains a polar group which can be decomposed through exposure to light or heat. One exemplary polar group which can be decomposed include azide ($N_3^-$), which can break down to release nitrogen gas ($N_2$). Another exemplary polar group is carboxylate ($—COO^-$), which can break down to release carbon dioxide gas ($CO_2$). Other polar groups may include peroxides, which can evolve oxygen gas ($O_2$). Generally, the byproducts of the decomposed surfactant may be either volatile products that readily evaporate from the imaging member, or may be products that are more amenable to pickup by cleaning rollers in the cleaning station. One means of determining whether the byproduct is easier to clean may be by referring to the enthalpy of vaporization, also known as the heat of vaporization, which has units of J/mol or J/kg, and is a measure of the ease with which a given compound will evaporate. Desirably, the enthalpy of vaporization for at least one of the byproducts is lower than the enthalpy of vaporization for the surfactant (i.e. less energy to evaporate).

In the second type of surfactant, the surfactant is a cis-trans isomer having a dipole moment. In particular, it is contemplated that the polarity of the surfactant can be changed by switching between the cis and trans isomers of the surfactant. The general mechanism can be better explained with reference to the isomers as illustrated in Scheme 2 below:

Scheme 2

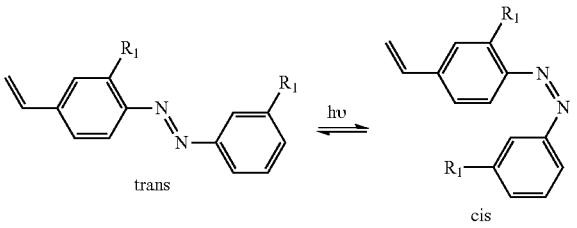

As seen here, in the trans isomer, the two polar $R_1$ groups are on the same side of a line drawn through the azo linkage. As a result, the overall surfactant can be considered a macrodipole, or in other words a dipole is present in the surfactant. However, in the cis isomer, the two polar $R_1$ groups are on opposite sides of the line drawn through the azo linkage, and a macrodipole is not present in the surfactant. In other words, the overall polarity of the surfactant can be tuned or controlled.

In some particular embodiments, the cis-trans isomer is an azobenzene compound having the structure of Formula (III):

Formula (III)

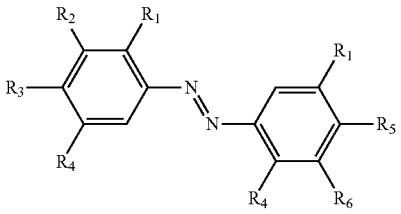

wherein $R_1$, $R_2$, $R_3$, $R_4$, $R_5$, and $R_6$ are independently selected from hydrogen, hydroxyl, carboxylic acid, amino, thiol, cyano, nitro, halogen, vinyl, alkoxy, trialkylammoniumalkoxy, sulfonic acid, phosphonate ester, aldehyde, amide, urea, carbamate, carbonate, alkyl, polyoxyalkylene, and ester; and wherein $R_1$ is different from $R_4$. The overall compound of Formula (III) has a dipole moment.

The term "hydroxyl" refers to a radical of the formula —OH.

The term "carboxylic acid" refers to a radical of the formula —COOH.

The term "amino" refers to a radical of the formula $—NR^1R^2$, wherein $R^1$ and $R^2$ are independently hydrogen or alkyl, or to a radical of the formula $—N^+R^1R^2R^3$, wherein $R^1$, $R^2$, and $R^3$ are independently hydrogen or alkyl. Please note this second radical is sometimes referred to as an "ammonium" ion.

The term "thiol" refers to a radical of the formula —SH.

The term "cyano" refers to a radical of the formula —CN.

The term "nitro" refers to a radical of the formula $—NO_2$.

The term "halogen" refers to a fluorine, chlorine, bromine, or iodine atom.

The term "vinyl" refers to a radical of the formula $—CH{=}CH_2$.

The term "alkoxy" refers to a radical of the formula $—OC_nH_{2n+1}$.

The term "trialkylammoniumalkoxy" refers to a radical of the formula $—OR^1—N^+R^2R^3R^4A^-$, wherein $R^1$, $R^2$, $R^3$, and $R^4$ are independently alkyl, and A is an anion, such as bromine or chlorine.

The term "sulfonic acid" refers to a radical of the formula $—SO_3H$.

The term "phosphonate ester" refers to a radical of the formula $—O(P{=}O)(OR^1)(OR^2)$, wherein $R^1$ and $R^2$ are independently hydrogen, alkyl, or aryl.

The term "aldehyde" refers to a radical of the formula $—CO—R^1$, wherein $R^1$ is hydrogen or alkyl.

The term "amide" refers to a radical of the formula $—CO—NR^1R^2$, wherein $R^1$ and $R^2$ are independently hydrogen or alkyl.

The term "urea" refers to a radical of the formula $—NR^1—CO—NR^2R^3$, wherein $R^1$, $R^2$, and $R^3$ are independently hydrogen or alkyl.

The term "carbamate" refers to a radical of the formula $—O—CO—NR^1R^2$, wherein $R^1$ and $R^2$ are independently hydrogen or alkyl.

The term "carbonate" refers to a radical of the formula $—O—CO—OR^1$, wherein $R^1$ is hydrogen or alkyl.

The term "alkyl" refers to a radical composed entirely of carbon atoms and hydrogen atoms which is fully saturated. The alkyl radical may be linear, branched, or cyclic. The alkyl radical may be monovalent or divalent depending on context, i.e. $—C_2H_5$ and $—C_2H_4—$ would both be considered alkyl.

The term "polyoxyalkylene" refers to a radical of the formula $—(OR^1)_m—X$, wherein each $R^1$ is independently alkyl; m is an integer and is at least 2; and X is hydrogen or hydroxyl.

The term "ester" refers to a radical of the formula $—CO—OR^1$, wherein $R^1$ is hydrogen or alkyl.

The term "aryl" refers to an aromatic radical composed entirely of carbon atoms and hydrogen atoms. When aryl is described in connection with a numerical range of carbon atoms, it should not be construed as including substituted aromatic radicals. For example, the phrase "aryl containing from 6 to 10 carbon atoms" should be construed as referring to a phenyl group (6 carbon atoms) or a naphthyl group (10 carbon atoms) only, and should not be construed as including a methylphenyl group (7 carbon atoms). The aryl radical may be monovalent or divalent depending on context, i.e. $—C_6H_5$ and $—C_6H_4—$ would both be considered phenyl.

In some more specific embodiments, the cis-trans isomer is an azobenzene compound having the structure of Formula (III-a):

Formula (III-a)

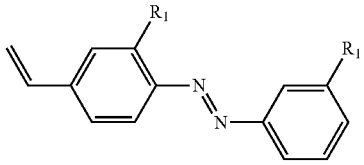

wherein $R_1$ is selected from hydroxyl, amino, cyano, nitro, halogen, vinyl, alkoxy, sulfonic acid, aldehyde, and ester.

In another specific embodiment, the cis-trans isomer is an azobenzene compound having the structure of Formula (III-b):

Formula (III-b)

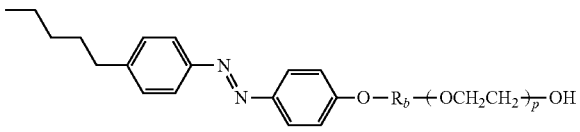

wherein $R_b$ is alkyl having 2 to 6 carbon atoms; and p is an integer from 1 to 10. Here, the two sidechains are a nonpolar alkyl sidechain and a polar polyoxyalkylene sidechain.

In yet another specific embodiment, the cis-trans isomer is an azobenzene compound having the structure of Formula (III-c):

Formula (III-c)

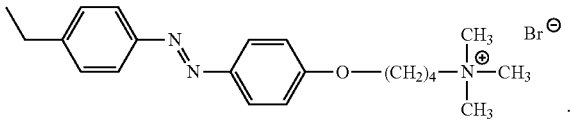

Here, the two sidechains are a nonpolar alkyl sidechain and a polar trialkylammoniumalkoxy sidechain.

In the third type of surfactant, the surfactant is polymerizable. This allows the surfactant to participate in the polymerization of the ink during curing, and eventually removes the surfactant from the surface of the imaging member. Generally speaking, the surfactant contains a polymerizable group. Exemplary polymerizable groups include a carbon-carbon double bond or a carbon-carbon triple bond, or moieties containing such bonds. For example, an alkylmethacrylate group of the general formula $—(C_nH_{2n})—O—CO—C(CH_3)=CH_2$ contains a polymerizable carbon-carbon double bond.

The surfactant generally has the structure of Formula (IV):

T-G Formula (IV)

wherein T is a nonpolar group; G is a polar group; and a polymerizable group is present in either T or G. It is contemplated that T represents the nonpolar tail, while G represents the polar head of the surfactant.

A "polar" group is a radical that has an electric dipole moment. Examples of some polar groups include hydroxyl, amino, cyano, nitro, halogen, alkoxy, sulfonic acid, aldehyde, ester, polyoxyalkylene, and combinations thereof.

A "nonpolar" group is a radical that does not have an electric dipole moment. Examples of some nonpolar groups include alkyl and aryl.

In some particular embodiments, the polymerizable surfactant may have the structure of Formula (IV-a):

Formula (IV-a)

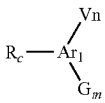

wherein $R_c$ is alkyl containing from 4 to 24 carbon atoms; $Ar_1$ is aryl having from 6 to 40 carbon atoms; Vn is a hydrocarbon chain having a single carbon-carbon double bond; G is independently a polar group; m is an integer indicating the number of polar groups G on $Ar_1$, and is from 1 to 4. Referring back to Formula (IV), the $R_c$ and $Ar_1$ groups may be considered to be the nonpolar tail of the surfactant, with the G group(s) providing the polarity. The carbon-carbon double bond of the Vn group allows the surfactant to be polymerized.

The term "hydrocarbon chain" refers to a radial composed entirely of carbon atoms and hydrogen atoms which is not aromatic. A vinyl group is an example of a hydrocarbon chain.

In more specific embodiments, the $R_c$ group is alkyl having from 12 to 18 carbon atoms. The $R_c$ group is usually a linear alkyl group. In other embodiments, the Vn group has from 2 to 6 carbon atoms. In some embodiments, $Ar_1$ is phenyl. In additional embodiments, G contains a polyoxyethylene chain.

In particular embodiments, the polymerizable surfactant has the structure of Formula (IV-b):

Formula (IV-b)

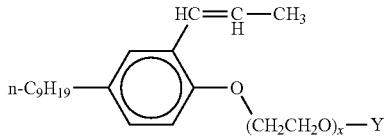

wherein x has an average value of from 1 to about 50; and Y is hydrogen or $—SO_3^-M^+$, where M is a cation having a +1 charge. Some exemplary M cations include ammonium ($NH_4^+$), sodium, and potassium. Such polymerizable surfactants are commercially available under the names NOIGEN RN (polyoxyethylene alkylphenyl ether) and HITENOL (polyoxyethylene alkylphenyl ether ammonium sulfate) from Montello Inc.

In other embodiments, the polymerizable surfactant is 10-undecenoic acid, which has the structure of Formula (IV-c):

Formula (IV-c)

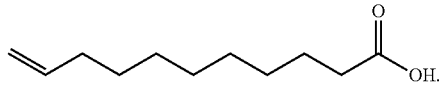

Here, the —COOH group is the polar head, with the decenyl chain acting as the nonpolar tail, and the double bond being the polymerizable group.

In still other embodiments, the polymerizable surfactant has the structure of Formula (IV-d):

Formula (IV-d)

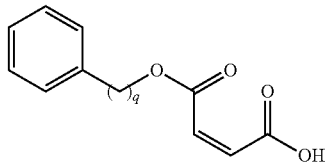

wherein q is an integer from 1 to 7.

The dampening fluids of the present disclosure comprise water and one of the surfactants described above having an alterable structure. The water may be from about 70 wt % to about 95 wt % of the dampening fluid. The surfactant is present in an amount such that the surface tension of the dampening fluid is from about 20 to about 40 dynes/cm. In other embodiments, the surfactant is from about 0.5 wt % to about 2 wt % of the dampening fluid.

In addition, the dampening fluid may also contain a low molecular weight alcohol that functions as a wetting agent. This ensures uniform distribution of the solution on the imaging member and decreases the amount of water on the imaging member. In particular embodiments, the low molecular weight alcohol contains from 1 to 6 carbon atoms.

Specific alcohols include isopropanol and ethanol. The low molecular weight alcohol may be present in the amount of about 5 wt % to about 35 wt % of the dampening fluid.

Other additives may also be present in the dampening fluid. Such additives may include a biocide, a sequestrant, a corrosion inhibitor, and a humectant.

A biocide impedes the growth of or destroys any fungus or microorganisms that may be present in the dampening fluid. Exemplary biocides include sodium benzoate, phenol or derivatives thereof, formalin, imidazole derivatives, sodium dehydroacetate, 4-isothiazolin-3-one derivatives, benzotriazole derivatives, derivatives of amidine and guanidine, quaternary ammonium salts, derivatives of pyridine, quinoline and guanidine, derivatives of diazine and triazole, derivatives of oxazole and oxazine, bromonitropropanol, 1,1-dibromo-1-nitro-2-ethanol, and 3-bromo-3-nitropentane-2,4-diol. The biocide can be used in an amount of from about 0.001 wt % to about 1 wt % of the dampening fluid.

A sequestrant, or chelating agent, is used to chelate dissolved ions that may be present in the dampening fluid to prevent their reaction with other ingredients in for example the ink. Exemplary sequestrants include organic phosphonic acids and phosphonoalkanetricarboxylic acids, such as ethylenediaminetetraacetic acid (EDTA), diethylenetriaminepentaacetic acid, triethylenetetraminehexaacetic acid, hydroxyethylethylenediaminetriacetic acid, nitrilotriacetic acid, 1-hydroxyethane-1,1-diphosphonic acid, aminotri(methylenephosphonic acid), and salts thereof. The sequestrant can be used in an amount of from about 0.001 wt % to about 1 wt % of the dampening fluid.

A corrosion inhibitor protects the associated components of the imaging member from corrosion. Exemplary inhibitors include sodium nitrate, sodium phosphate, benzotriazole, 5-methylbenzotriazole, thiosalicylic acid, and benzimidazole.

A humectant prevents the dampening fluid from drying too rapidly, which can cause some problems with the final printed product. Exemplary humectants include ethylene glycol, glycerin and propylene glycol.

The surfactants of the present disclosure can be more easily removed from the surface of the imaging member. It is contemplated that the state of a surfactant can be switched by exposure to light or heat so that the surfactant alters or transforms into a compound or compounds that is/are easier to remove. There are two main situations in which surfactant needs to be removed. The first situation is in the image areas (where ink is applied). In these areas, the surfactant can be volatilized, cracked, or otherwise converted. For example, the surfactant could be exposed at the imaging station 130 to light or heat over subsequent rotations of the imaging member to accomplish this task. Alternatively, the air knife 77 illustrated in FIG. 1 could be replaced with an additional light or heat source that is upstream of cleaning subsystem 72. This additional light or heat source 77 could be a laser or a thermal imaging print bar that could heat an entire cross-process line on the imaging member. The second situation is in the non-image areas, where dampening fluid may remain after the ink has been split. Again, the additional light or heat source 77 can be used to remove this surfactant.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

What is claimed is:

1. A method for cleaning an imaging member during offset lithographic printing, comprising:

coating the imaging member with a dampening fluid that comprises water and a surfactant having an alterable structure;

after an ink transfer from the imaging member and before a subsequent latent image forming step on the imaging member, exposing the imaging member to light or heat to alter the structure of the surfactant across the imaging member; and removing the surfactant from the imaging member, wherein the surfactant includes a cis-trans isomer having a dipole moment.

2. The method of claim 1, wherein the cis-trans isomer is an azobenzene compound.

3. The method of claim 1, wherein the cis-trans isomer is an azobenzene compound having the structure of Formula (III):

Formula (III)

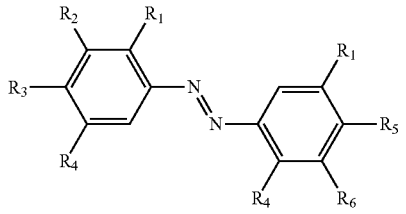

wherein $R_1$, $R_2$, $R_3$, $R_4$, $R_5$, and $R_6$ are independently selected from hydrogen, hydroxyl, carboxylic acid, amino, thiol, cyano, nitro, halogen, vinyl, alkoxy, trialkylammoniumalkoxy, sulfonic acid, phosphonate ester, aldehyde, amide, urea, carbamate, carbonate, alkyl, polyoxyalkylene, and ester; and wherein $R_1$ is different from $R_4$.

4. The method of claim 1, wherein the cis-trans isomer is an azobenzene compound having the structure of Formula (III-a):

Formula (III-a)

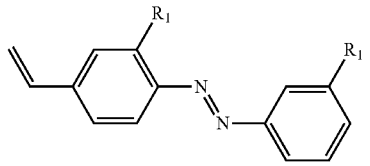

wherein R1 is selected from hydroxyl, amino, cyano, nitro, halogen, vinyl, alkoxy, sulfonic acid, aldehyde, and ester.

5. The method of claim 1, wherein the cis-trans isomer is an azobenzene compound having the structure of Formula (III-b):

Formula (III-b)

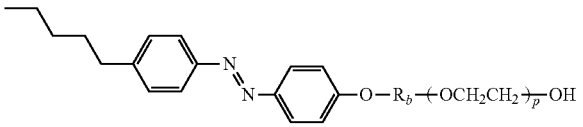

wherein $R_b$ is alkyl having 2 to 6 carbon atoms; and p is an integer from 1 to 10.

6. The method of claim 1, wherein the cis-trans isomer is an azobenzene compound having the structure of Formula (III-c):

Formula (III-c)

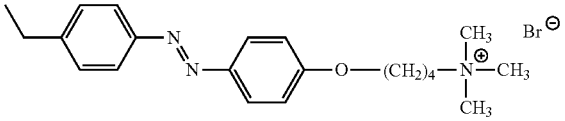

7. The method of claim 6, wherein Formula (III-c) includes a nonpolar alkyl sidechain and a polar trialkylammoniumalkoxy sidechain.

8. A method for cleaning an imaging member during offset lithographic printing, comprising:

coating the imaging member with a dampening fluid that comprises water and a surfactant having an alterable structure;

exposing the imaging member to light or heat to alter the structure of the surfactant; and removing the surfactant from the imaging member, wherein the surfactant includes a cis-trans isomer having a dipole moment, the cis-trans isomer including an azobenzene compound having the structure of Formula (III):

Formula (III)

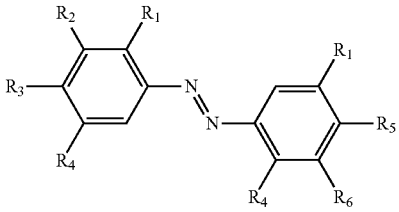

wherein $R_1$, $R_2$, $R_3$, $R_4$, $R_5$, and $R_6$ are independently selected from hydrogen, carboxylic acid, amino, thiol, cyano, nitro, halogen, vinyl, alkoxy, trialkylammoniumalkoxy, sulfonic acid, phosphate ester, aldehyde, amide, urea, carbonate, carbonate, alkyl, polyoxyalkylene, and ester; and wherein $R_1$ is different from $R_4$.

9. A method for cleaning an imaging member during offset lithographic printing, comprising:

coating the imaging member with a dampening fluid that comprises water and a surfactant having an alterable structure;

exposing the imaging member to light or heat to alter the structure of the surfactant; and removing the surfactant from the imaging member, wherein the surfactant includes a cis-trans isomer having a dipole moment, the cis-trans isomer including an azobenzene compound having the structure of Formula (III-a):

Formula (III-a)

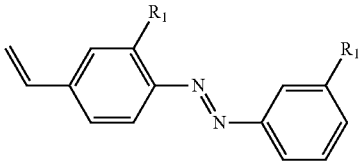

wherein R1 is selected from hydroxyl, amino, cyano, nitro, halogen, vinyl, alkoxy, sulfonic acid, aldehyde, and ester.

10. A method for cleaning an imaging member during offset lithographic printing, comprising:

coating the imaging member with a dampening fluid that comprises water and a surfactant having an alterable structure;

exposing the imaging member to light or heat to alter the structure of the surfactant; and removing the surfactant from the imaging member, wherein the surfactant includes a cis-trans isomer having a dipole moment, the cis-trans isomer including an azobenzene compound having the structure of Formula (III-b):

Formula (III-b)

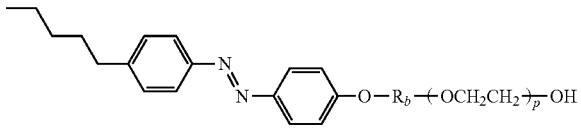

wherein $R_b$ is alkyl having 2 to 6 carbon atoms; and p is an integer from 1 to 10.

11. A method for cleaning an imaging member during offset lithographic printing, comprising:

coating the imaging member with a dampening fluid that comprises water and a surfactant having an alterable structure;

exposing the imaging member to light or heat to alter the structure of the surfactant; and removing the surfactant from the imaging member, wherein the surfactant includes a cis-trans isomer having a dipole moment, the cis-trans isomer including an azobenzene compound having the structure of Formula (III-c):

Formula (III-c)

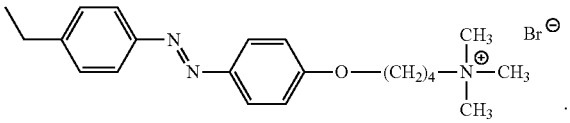

12. The method of claim 11, wherein Formula (III-c) includes a nonpolar alkyl sidechain and a polar trialkylammoniumalkoxy sidechain.

13. The method of claim 1, wherein the exposing the imaging member to light or heat to alter the structure of the surfactant across the imaging member includes exposing entire cross-process lines on the imaging member to light or heat.

14. The method of claim 1, wherein the exposing the imaging member to light or heat to alter the structure of the surfactant across the imaging member includes exposing entire cross-process lines on the imaging member to light or heat at both imaged and non-imaged areas of the imaging member.

* * * * *